US009771538B2

(12) United States Patent
Tanner

(10) Patent No.: US 9,771,538 B2
(45) **Date of Patent: *Sep. 26, 2017**

(54) BIO-BASED LUBRICANTS

(71) Applicant: Ethox Chemicals, LLC, Greenville, SC (US)

(72) Inventor: James T Tanner, Greer, SC (US)

(73) Assignee: Ethon Chemicals, LLC, Greenville, SC (US)

( * ) Notice: Subject to any disclaimer, the term of this patent is extended or adjusted under 35 U.S.C. 154(b) by 250 days.

This patent is subject to a terminal disclaimer.

(21) Appl. No.: 14/517,822

(22) Filed: Oct. 18, 2014

(65) Prior Publication Data

US 2015/0267139 A1 Sep. 24, 2015

Related U.S. Application Data

(63) Continuation-in-part of application No. 14/219,590, filed on Mar. 18, 2014, now abandoned.

(60) Provisional application No. 61/786,677, filed on Mar. 15, 2013.

(51) Int. Cl.

| | |
|---|---|
| ***C10M 105/30*** | (2006.01) |
| ***C10M 101/04*** | (2006.01) |
| ***C10M 169/04*** | (2006.01) |
| ***C10M 177/00*** | (2006.01) |
| ***C10M 105/26*** | (2006.01) |
| ***C10M 111/02*** | (2006.01) |

(52) U.S. Cl.

CPC ..... *C10M 101/04* (2013.01); *C10M 105/26* (2013.01); *C10M 111/02* (2013.01); *C10M 169/04* (2013.01); *C10M 177/00* (2013.01); *C10M 2207/127* (2013.01); *C10M 2207/1273* (2013.01); *C10M 2207/401* (2013.01); *C10N 2210/01* (2013.01); *C10N 2250/10* (2013.01)

(58) Field of Classification Search

CPC ..... C10M 105/26; C10M 105/30; C10M 2207/1203; C10M 2207/401

USPC ..... 508/491

See application file for complete search history.

(56) References Cited

U.S. PATENT DOCUMENTS

| | | | | |
|---|---|---|---|---|
| 2014/0243549 | A1* | 8/2014 | Tanner | C11C 3/00 560/196 |
| 2014/0256605 | A1* | 9/2014 | Bertin | C10M 123/02 508/178 |
| 2014/0274832 | A1* | 9/2014 | Brekan | C10M 159/12 508/154 |
| 2015/0057204 | A1* | 2/2015 | Brekan | C10M 129/72 508/496 |
| 2015/0197702 | A1* | 7/2015 | Bertin | C10M 117/06 508/512 |

* cited by examiner

*Primary Examiner* — Ellen McAvoy

(74) *Attorney, Agent, or Firm* — Joseph T. Guy; Perkins Law Firm, LLC

(57) ABSTRACT

The invention provides biobased lubricants comprising the reaction product of a natural oil, fatty acid or derivative having unsaturation sites with a suitable substrate such as maleic anhydride that is capable of undergoing an "ene" or Diels Alder reaction with the natural oil to form an adduct; followed by a controlled non-aqueous neutralization with a suitable inorganic base such as lithium hydroxide.

34 Claims, No Drawings

BIO-BASED LUBRICANTS

This application is a continuation-in-part of pending U.S. application Ser. No. 14/218,950 entitled "Bio-based Lubricants" filed Mar. 18, 2014, the entire contents of which are incorporated by reference herein which, in turn, claims the priority benefit under 35 U.S.C. section 119 of U.S. Provisional Patent Application No. 61/786,677 entitled "Bio-based Lubricants" filed on Mar. 15, 2013, and which is in its entirety herein incorporated by reference.

FIELD OF THE INVENTION

The present invention is directed to natural and vegetable oil derivatives. More particularly, the present invention is directed to functionalized vegetable oil derivatives that can be used as biolubricants. The present invention is further directed to lubricant compositions. More specifically the invention relates to biolubricant compositions. More particularly, the invention relates to derivatives of natural oils that have a high level of renewable raw materials that are useful as lubricants.

This invention also relates to methods of making natural oil based lubricants, and specifically to methods of synthesizing natural oil based lubricants, particularly wherein they are made from at least one biologically-derived precursor.

This invention further relates generally to lubricants derived from biomass, and specifically to methods and systems for efficiently making biolubricants from natural and or vegetable or crop oils.

The present invention is also directed to biolubricants derived from maleating unsaturated triglyceride oils from vegetable sources and or other natural sources. The reaction product is a succinated vegetable or natural oil. That reaction product can be further reacted with lithium hydroxide or lithium carbonate to form biolubricants.

BACKGROUND OF THE INVENTION

Biolubricants, also known as bio-based lubricants or bio-lubes, are typically made from a variety of vegetable oils, such as rapeseed, canola, sunflower, soybean, palm, and coconut oils. The best application for biolubricants is in machinery that loses oil directly into the environment during use, total loss lubricants (TLLs), and in machinery used in any sensitive areas, such as in or near water. Applications for TLLs include two-stroke engines, chainsaw bars and chains, railroad flanges, cables, dust suppressants, and marine lubricants.

Compared to petroleum-based lubricants, use of biolubricants: (1) Produces a cleaner, less toxic work environment and fewer skin problems for those working with engines and hydraulic systems; (2) offers better safety due to higher flashpoints, constant viscosity, and less oil mist and vapor emissions; (3) produces fewer emissions due to higher boiling temperature ranges; (4) are highly biodegradable; and (5) costs less over the product's life-cycle due to less maintenance, storage and disposal requirements.

The use of biolubricants can reduce pollution in stormwater from leaks in engines, hydraulic systems, and brake lines. Many European countries now require biolubricants in selected environmentally sensitive areas.

Since biolubricants outperform petroleum lubricants, less is required per application. Cost benefits include reductions in environmental and safety penalties in the case of spills, and less parts wear, maintenance costs, and disposal fees. Biolubricants evaporate slower than petroleum lubricants and adhere better to metal surfaces. They have several disadvantages in the use phase of the product life cycle, including some bad odors if contaminants are present, high viscosity at low temperatures and poor oxidative stability at high temperatures, although additives designed specifically for plant-based lubricants eliminate stability issues related to extreme high and low temperatures.

More than 50 percent of all lubricants used are estimated to end up in the environment. This would amount to more than 1.25 billion gallons in the U.S. based on a 2006 National Petroleum Refiners Association Report. Although most biolubricants contain a small percentage of additives that are not biodegradable, the quantity of toxins present is significantly less than petroleum lubricants. Thus, used, accidentally spilled, or leaked biolubricants will not contaminatestreams nor kill vegetation and wildlife.

The lubricants (engine and non-engine) and process fluids industries today are searching for materials that are biodegradable. Biodegradability means that the lubricants and process fluids (hereinafter "fluids") degrade over a period of time, which may be measured by tests such as those promulgated by the Organization of Economic Co-Operation and Development (OECD), including OECD 301B and OECD 301F. Recently, interest has been increasing in fluids which are not only biodegradable, but also renewable. Renewable products contain, by definition, high levels of renewable carbons, and standards are being set to encourage increasingly greater levels of renewability. For example, the European Ecolabel now requires that hydraulic fluids must contain at least 50 percent by weight renewable carbons.

Researchers have attempted to meet requirements or recommendations for both biodegradability and renewability by including in their fluids formulations a variety of types of natural and synthesized oils. Unfortunately, many of these materials exhibit pour points that are too high to enable use in certain important applications. The pour point is the lowest temperature at which the fluid will flow, and pour points below 0° C., desirably below −10° C., more desirably below −15° C., and even below −25° C., are often necessary. These materials in many cases also suffer from poor thermo-oxidative stability at high temperatures (for example, above 90° C.), which may in some cases be due to the amount of unsaturation present in the acid fraction of their chemical structures.

Also, due to increasing environmental concerns, there has been considerable interest in developing lubricant and grease compositions based on renewable resources. Conventional lubricants and greases are based on petroleum derived hydrocarbons that have been viscosified with lithium soaps such as lithium stearate and lithium 12-hydroxystearate. The same technology has been applied to the manufacture of lubricants and greases based on natural oils, particularly soybean oil. Several disadvantages are inherent with this technology. The lithium soaps are difficult to dissolve in the soybean oil, and precise viscosity control is difficult. The viscosity and other properties of the lubricant are controlled by the fatty acid structure requiring a variety of different lithium soaps to be synthesized.

Biolubricants are of increasing interest for a number of reasons including: (1) they are a renewable resource, (2) their production is less dependent on geopolitical considerations, (3) they provide the possibility of a direct replacement of petroleum-based lubricants in existing vehicles, and (4) the net greenhouse gas emissions can be substantially reduced by virtue of $CO_2$ uptake by biolubricant precursors-particularly in the case of cellulose feedstocks.

An easily-obtainable biolubricant is a naturally occurring vegetable oil, which largely comprises triglycerides and some free fatty acids. The properties of vegetable oil, however, make it generally inappropriate for use as a direct replacement for petroleum lubricants in vehicle engines, as the vegetable oils' viscosities may not be adequate and the potential exists for leaving damaging carbon deposits. Additionally, vegetable oils tend to gel at lower temperatures, thereby hindering their use in colder climates.

It is also worth noting that unsaturation in the fatty acid contributes to poor oxidation stability and deposits, and that while hydrogenation will generally improve the oxidation stability of the lubricant, it can make the already poor low temperature performance of the lubricant even worse.

Additionally, lubricants derived from renewable feedstocks such as animal or vegetable oils or fats would be desirable to help reduce the dependence of the United States on foreign oil. Lubricating oils based on renewable sources such as vegetable and animal oils and fats have a number of advantages. The vegetable and animal oils or fats contain triglycerides having ester carbonyl groups. The polar nature of these ester carbonyl groups leads to strong adsorption on metal faces as a very thin film so that the film forming properties of triglyceride based lubricants are particularly advantageous in hydraulic systems. Vegetable oils and animal oils typically have high viscosity indices that facilitate their use over wide temperature ranges. Furthermore, they typically have high fume points (e.g., about 2000 C) and high flash points (e.g., about 3000 C).

In addition, vegetable and animal oil and fat based lubricants help reduce the depletion of fossil-derived hydrocarbons. Moreover, vegetable oil based lubricants are typically biodegradable, which would help reduce the introduction of waste lubricants into the environment. Currently, about 50% of mineral lubricants used worldwide end up in landfills and the like.

However, there are major problems in using oils from renewable feedstocks such as plant oils, (i.e. soybean oils and other vegetable oils), or oils or fats derived from animal sources, (e.g. menhaden, lard, butterfat and other animal derived oils) as lubricants, including: (1) low oxidative stability; (2) relatively low viscosities; and (3) tendencies to solidify at low operating temperatures as manifested by relatively high pour points (temperatures below which they will no longer pour).

Therefore, there is a need for a lubricant based on a renewable feedstock that could be modified to provide the desired properties.

The present invention overcomes these disadvantages inherent in the prior art by providing natural oil based lithium lubricants that do not require the addition of gellants. The compositions are provided by a simple economical process that allows precise viscosity control of the lubricants.

SUMMARY OF THE INVENTION

The invention is directed to the reaction product of maleating a triglyceride oil from a plant or land animal followed by neutralization with a lithium base which was unexpectedly found to be particularly useful as biobased lubricants. The triglyceride oils are readily available in a variety of purities and readily undergo thermal maleation. The maleated products are often called succinated triglyceride oils because the maleic anhydride loses one carbon-to-carbon double bond in the thermal coupling reaction, while introducing it (i.e. converting the maleic acid or anhydride to a succinic acid or succinic anhydride substituent). In the present application, the terms "succination" and "maleation" can be used interchangeably to convey the concept and description of the natural oil functionalization.

The lithium base neutralized and functionalized vegetable or land animal triglyceride oil offers a new material having good lubricity, low toxicity, and constitutes a novel and efficient use for these neutralized and polar-functionalized triglyceride oils.

The reaction product of maleic anhydride and a triglyceride oil can be made by the thermal condensation of maleic anhydride or other unsaturated carboxylic acid capable of undergoing either "Ene" or "Diels-Alder" adduction to the unsaturated sites in vegetable oils. The modified triglyceride oils then neutralized with a lithium base such as lithium hydroxide or lithium carbonate.

The invention also provides natural oil based lubricants of formulas (i) and (ii):

(i)

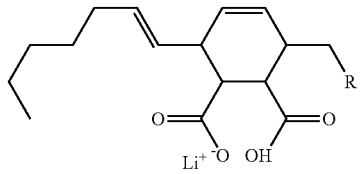

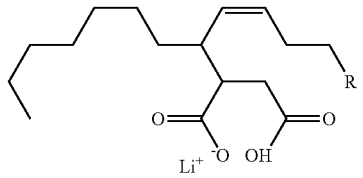

(ii)

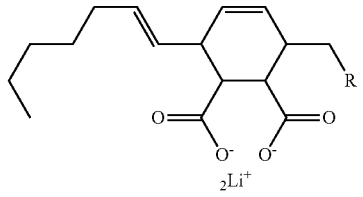

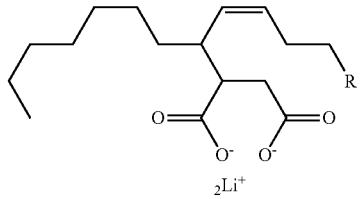

where R represents the additional carbon and functional moieties associated with a natural oil and where the natural oil or natural oil derivative contains greater than about 80 percent of unsaturated or conjugated unsaturated fatty acids and wherein said lubricant is the reaction product of said natural oil or natural oil derivative with a substrate capable of undergoing an ene or Diels Alder reaction to form an adduct that is further reacted in a neutralization reaction with a lithium base to form an anhydrous gel.

The invention further provides a method for making lubricants based on natural oils and derivatives thereof of formulas (i) and (ii):

(i)

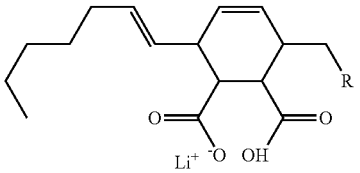

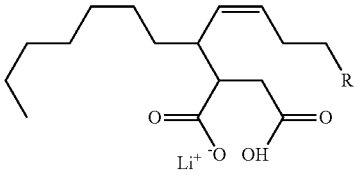

(ii)

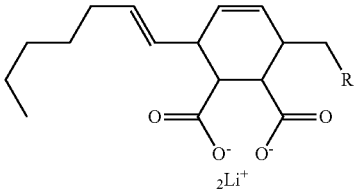

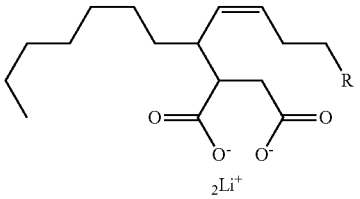

where R represents the additional carbon and functional moieties associated with a natural oil and where the natural oil or natural oil derivative contains greater than about 80 percent of unsaturated or conjugated unsaturated fatty acids said method comprising: (a) reacting the natural oil fatty acid or derivative with a substrate that is capable of undergoing an "ene" or Diels Alder reaction with the natural oil to form an adduct; and (b) subjecting the product of step (a) to a controlled non-aqueous neutralization with a suitable inorganic base.

DETAILED DESCRIPTION OF THE PRESENT INVENTION

The compositions of the present invention are provided by a two step process. In the first step, the natural oils, or combination thereof, are reacted with an enophile or enophile/dienophile mixture that contains acid, half ester or anhydride functionality to form a modified natural oil. The unsaturated natural oil or derivative thereof is modified by a process in which the double bonds and/or conjugated double bonds of the triglyceride oil chains are reacted via thermal condensation with an unsaturated substrate which is capable of undergoing an "ene" reaction or an Diels Alder reaction with the sites of unsaturation resulting in the formation of an adduct of the triglyceride oil. The adduct formed is preferentially an anhydride and the substrate reacted in this manner with the triglyceride oil is preferably maleic anhydride. The term "maleation" has been historically applied to the reaction of natural unsaturated oils, fatty acids and their derivatives with maleic anhydride. Functionaliztion of triglyceride oils by this method is well known in the art and is described in U.S. Pat. Nos. 2,033,131, 2,033,132 and 2,063,540. These adducts are generally referred to in the literature as "maleated oils" or maleinized oils". While maleic anhydride is the preferred unsaturated substrate for adduct formation due to it's low cost and stability, it is well known to those skilled in the art that any alpha-beta unsaturated molecule capable of undergoing a thermal "ene" reaction or a Diels Alder reaction may be employed. Specific non-limiting examples include maleic anhydride, maleic acid, ethyl maleic acid, dimethyl maleate, dibutyl maleate, monomethyl hydrogen maleate, mono-2-ethylhexyl hydrogen maleate, itaconic acid, itaconic anhydride, acrylic and methacrylic acid, fumaric acid, citric acid, aconitic acid, citraconic acid, citraconic anhydride, maleimide, maleamic acid and the like.

The natural oils or natural oil derivatives that may be used in the method of the present invention include any triglyceride oil or derivative of such that contains significant portions of unsaturated fatty acids. Natural triglyceride oils containing both non-conjugated and conjugated double bonds are suitable. Non-limiting examples of suitable triglyceride oils include soybean oil, linseed oil, safflower oil, sunflower oil, avocado oil, rapeseed oil, castor oil, corn oil, cottonseed oil, hempseed oil, oiticica oil, peanut oil, linseed oil, tabocca seed oil, cod oil, herring (or menhaden) oil, dehydrated castor oil, tall oil, rosin oil and tung oil. The fatty acids employed in the present invention generally correspond to the fatty acid components of the triglyceride oil and include oleic acid, linoleic acid, linolenic acid, tall oil fatty acid, gadoleic acid, ricinoleic acid and the like.

The natural oils, as described herein, also includes the fatty acids or fatty acid esters derived from the natural oils or fats. That is, the term 'natural oil" also includes unsaturated fatty acids and the corresponding esters thereof. Examples of such unsaturated fatty acids include oleic acid ($CH_3(CH_2)_7CH{=}CH(CH_2)_7COOH$), myristoleic acid ($CH_3(CH_2)_3CH{=}CH(CH_2)_7COOH$), palmitoleic acid ($CH_3(CH_2)_5$, $CH{=}CH(CH_2)_7COOH$), linoleic acid ($CH_3(CH_2)_4CH{=}CHCH_2CH{=}CH(CH_2)_7COOH$), α-linolenic acid ($CH_3CH_2CH{=}CHCH_2CH{=}CHCH_2CH{=}CH(CH_2)_7COOH$), arachidonic acid $CH_3(CH_2)_4CH{=}CHCH_2CH{=}CHCH_2CH{=}CHCH_2CH{=}CH(CH_2)_3COOH$, icosapentaenoic acid $CH_3CH_2CH{=}CHCH_2CH{=}CH{-}CH_2CH{=}CHCH_2CH{=}CHCH_2CH{=}CH(CH_2)_3COOH$, erucic acid $CH_3(CH_2)_7CH{=}CH(CH_2)_{11}COOH$), and docosahexaenoic acid $CH_3CH_2CH{=}CHCH_2CH{=}CHCH_2CH{=}CHCH_2CH{=}CHCH_2CH{=}CHCH_2CH{=}CHCH_2COOH$.

Derivatives of these fatty acids such as esters, amides etc. may also be used. These include but are not limited to methyl esters, ethyl esters, esters derived from longer chain alcohols, generally $C_4$-$C_{22}$ alcohols, esters derived from polyhydroxy alcohols such as glycerol, diglycerol and polyglycerols, pentaerythritol, dipentaerthyritol, trimethylolpropane, ditrimethylolpropane and the like. Also useful are diesters of glycols such as ethylene glycol, propylene glycol, butylene glycol and the like as well as polyols such as polyethylene glycol, polypropylene glycol, polybutylene glycol and the like.

The maleating step is carried out by reacting the natural oils having long-chain ethylenically unsaturated fatty compounds and the α, β-ethylenically unsaturated di-carboxy compound at a temperature of about 150° C. to 300° C. The long-chain fatty compound and the dicarboxy compound can be mixed together and heated to the desired reaction temperature. Alternatively, the dicarboxy compound can be added in increments to the long-chain fatty material while the latter is maintained at the desired reaction temperature. The continuous addition method is preferred because in commercial processes it can be controlled and reproduced, particularly when maleic anhydride is employed. When using maleic anhydride in a batch method, the exothermic temperature must be carefully controlled in order to prevent foaming and sublimation of the maleic anhydride. When the continuous addition method is used, the addition rate of maleic anhydride is controlled so that there is little or no refluxing.

This adduct reaction may be carried out at atmospheric pressure in an open vessel or under pressure in an autoclave. Maleic anhydride forms an adduct in almost quantitative yields in an open vessel and accordingly, sealed reactors are not necessary. Other dicarboxy compounds, which are less efficient adduct formers, will give higher yields when a sealed system is employed.

The ratio of α, β-ethylenically unsaturated dicarboxy compound to ethylenically unsaturated long-chain fatty compound in the reaction vessel can range from at least 0.5 moles to 2 or more of dicarboxy compound per equivalent of unsaturation in the unsaturated long-chain fatty compound. For example, the preferred naturally occurring glyceride oils, such as soybean oil or linseed oil, can be reacted with from at least 5% to 45% by weight of maleic anhydride to form adducts containing from about 0.5 to 4.5 moles of anhydride moieties per molecule of glyceride oil.

The reaction of the natural oils and the enophile or enophile/dienophile mixture may be performed in the presence or substantial absence of a double bond isomerization catalyst, such as iodine. Reactions of linoleic and linolenic acid containing natural oils with enophiles/dienophiles are well known. In instances where no double bond isomerization catalyst (e.g. iodine) is present and the temperature is above about 200° C., the reaction is known as the Alder-ene reaction where the addition occurs at a double bond site in the fatty acid chain forming an Alder-ene adduct, accompanied by diallylic shift of double bonds forming conjugated diene system. Such conjugated diene systems are the subject for a subsequent Diels-Alder cycloaddition reaction with a following equivalent of enophile/dienophile. By avoiding the use of iodine, it is possible to improve the yield of diadduct for linoleic and linolenic acid, and more essentially, promote Alder-ene addition for the oleic acid rest, where it may be the only possible functionalization pathway in given conditions. Thus, not using iodine catalyst allows one to achieve a higher degree of natural oil functionalization and introduce more enophile/dienophile moieties on average onto the natural oil backbone. The addition of iodine allows one to perform the reaction at lower temperatures at a trade-off of lower functionalization degree.

The adducts of the invention may also be represented by the following chemical structures:

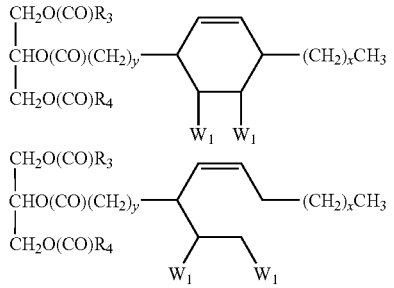

wherein x, y are integers of from 3 to 9, $R_3$ and $R_4$ are independently selected from saturated and unsaturated $C_7$-$C_{22}$ hydrocarbyl, each $W_1$ being $CO_2M$ and wherein M is H, or a lithium cation.

It should be noted that the above structures only show one maleic anhydride unit via Diels Alder and/or ene reaction. However, several units may be incorporated depending on the moles ratios that are selected and the number of unsaturation sites available in the natural oil.

In one non-limiting embodiment, maleic anhydride is reacted with an oil as seen in Scheme (I):

Scheme (I)

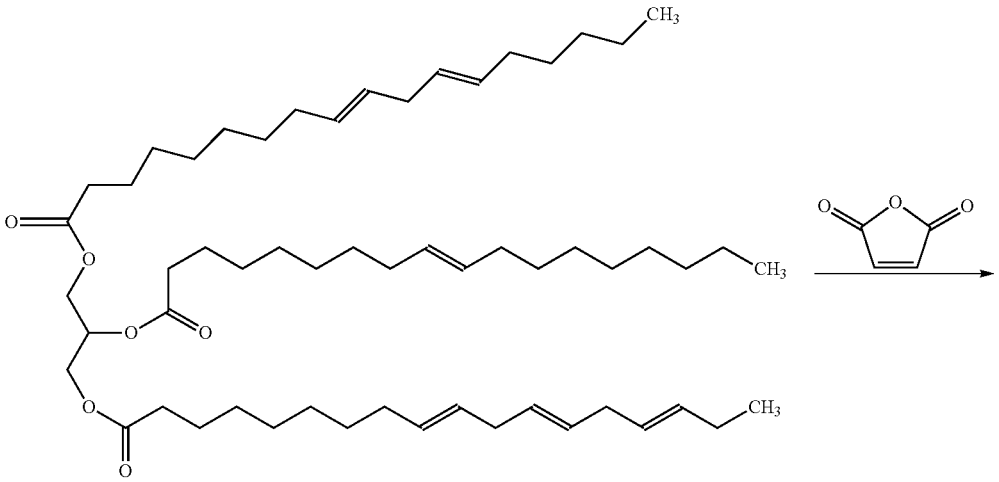

-continued

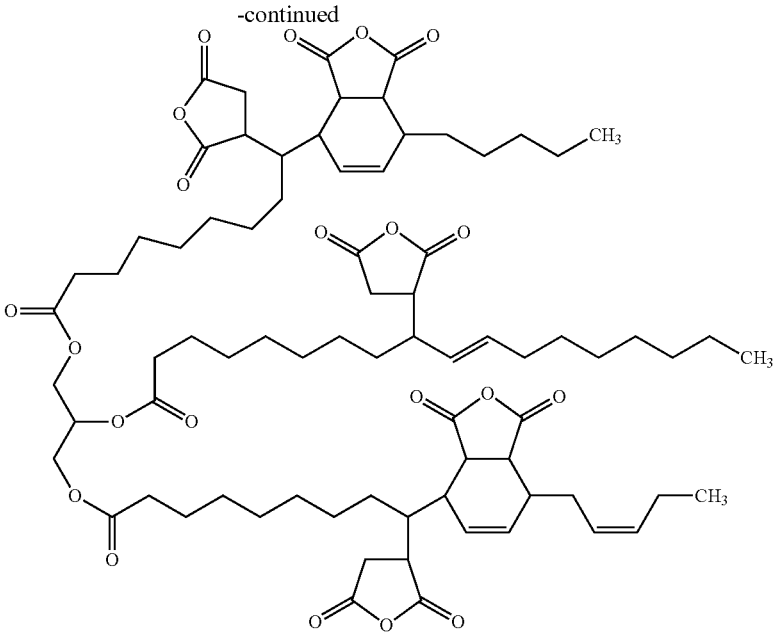

In the depicted particular example of Scheme (I), used for non-limiting illustration purposes only, the oil include the fatty acid rests of linoleic acid, oleic acid, and linolenic acid. The oil and/or fat composition may vary depending on the source of the oil and/or fat. Various combinations of the fatty acids linked with glycerol are possible, and may, in addition to unsaturated fatty acids, include saturated fatty acids such as stearic acid and palmitic acid. Another fatty acid may be ricinoleic acid, however interference between the hydroxyl of ricinoleic acid and the enophile may occur. The reaction of Scheme (I) may be performed at elevated temperatures, such as between about 150° C. and about 300° C., about 170° C. and about 200° C., or between about 180° C. and about 230° C. The reaction time may be between about 0.5 hours and about 10 hours. In one embodiment the reaction time is between about 1 hour and about 5 hours, and in another embodiment, between about 2 hours and 4 hours. In another embodiment, methyl oleate or oleic acid triglyceride may be reacted with maleic anhydride to afford 1:1 adducts resulting from Alder-ene addition. In another embodiment, methyl linoleate or linoleic acid triglyceride may be reacted with maleic anhydride to afford 1:1 adducts resulting from Alder-ene addition and 1:2 adducts formed by Alder-ene addition followed by Diels Alder cycloaddition.

In the second step, the adduct obtained is subjected to a reaction in which the anhydride ring is opened to form a fully or partially neutralized acid salt of the adduct. The neutralization reaction may be carried out in a completely anhydrous manner or the neutralizing agent may be dissolved in a small amount of water in order to decrease the reaction time. In either case, water that is added or formed during the neutralization is completely removed from the reaction mixture to provide an anhydrous ionomeric gel. Removal of the water may be conveniently carried out by simply boiling it off under a nitrogen sparge or vacuum may be applied if desired. While not being bound by any particular theory, it is believed that thermoreversible gelation occurs via the formation of ionomeric or physical crosslinks through reversible ionic aggregation of the metal carboxylate groups formed upon neutralization. Such thermoreversible aggregation of ionic groups is well known in certain polymers but has heretofore been unreported in functionalized natural oils. Depending on the composition of the starting triglyceride oil, fatty acid or derivative, both Diels Alder adducts and/or ene adducts are possible; Diels Alder adducts predominating where the triglyceride or derivative contains conjugated double bonds. (Fig. 1)

FIG. 1

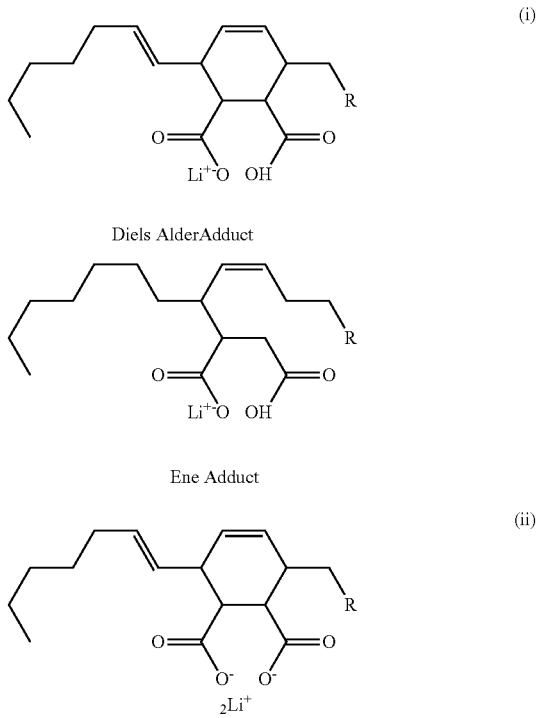

-continued

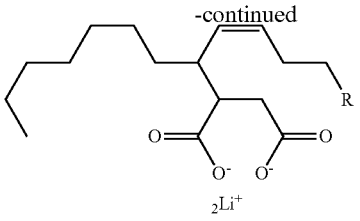

where R represents the additional carbon and functional moieties associated with a natural oil. The R moiety is basically the remaining part of the triglyceride oil, fatty acid or fatty acid derivative that has not reacted with the unsaturated substrate that is used for the ene or Diels Alder reaction.

To understand what is meant by the additional carbon and functional moieties the structure of soybean oil is depicted below:

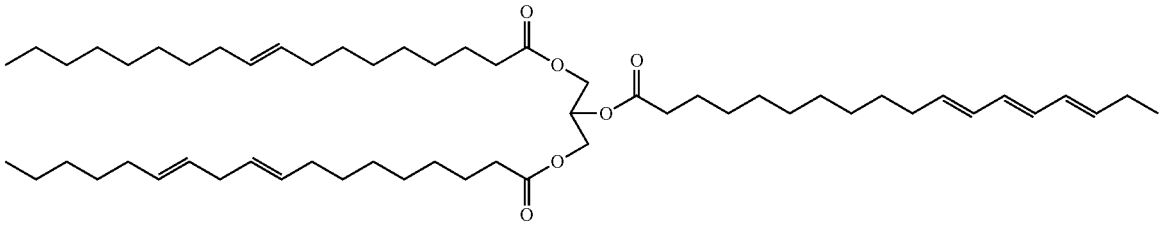

In the case of the above and all conjugated oils, the R represents all carbon and functional moieties to the left of the conjugated sites.

The neutralization is preferably carried out by the addition of lithium hydroxide or lithium carbonate in a quantity sufficient to react with some or all of the anhydride moieties with subsequent formation of the fully neutralized or partially neutralized maleic acid moieties which then results in gel formation. While the base may be added in an amount just sufficient to neutralize the maleic acid moieties, it is not necessary or generally desirable to fully neutralize both of the maleic acid groups in order to produce sufficient gelation of the oil. It is generally desirable to add less than the theoretical amount of base required to fully neutralize the anhydride/acid functionality. Depending on the desired viscosity, the preferred level of neutralization is from about 10 to about 100 percent, and more preferably from about 20 to about 60 percent of the theoretical amount of lithium base based on the mole percent of maleic or other adduct in the triglyceride oil. Higher levels of neutralization are generally not necessary to produce sufficient gelation of the oil. At maleation levels of 12 to 14 percent it is generally not necessary to neutralize beyond 50 percent of the theoretical amount based on the mole percent of maleic or other adduct in the triglyceride oil in order to obtain hard gels. The remaining acid functionality may be further neutralized to render the gel soluble in water or left uneutralized. This method allows gels to be produced that have the unique property of being both oil and water soluble.

This method thus has advantages over the prior art in that the lubricant is produced by a "self gelling" process that does not require the addition of soaps or gelling agents. Another advantage of the method of the present invention over the prior art is that the viscosity of the lubricants may be precisely controlled. The viscosity of the lubricants of the present invention is dependant upon the level of maleation of the natural oil or derivative and also the level of neutralization. For a given level of maleation, the viscosity increases as the level of neutralization increases. For a given level of neutralization, the viscosity increases as the level of maleation increases. Thus a high level of maleation combined with a low level of neutralization produces more oil soluble viscous lubricants, whereas a lower level of maleation combined with a higher level of neutralization produces more water soluble viscous lubricants.

EXAMPLES

The following examples are intended to demonstrate the usefulness of preferred embodiments of the present invention and should not be considered to limit its scope or applicability in any way.

Examples 1-11

The following method was used to prepare the natural oil based lubricants in Table 1. In a first step, 2000 g of the natural oil and the desired amount (as shown in the table) of maleic anhydride were charged to a 3 L four-neck round-bottom flask. The contents of the flask were gradually heated to 210° C. with agitation under a nitrogen sparge. The reaction mixture was held at this temperature until no free maleic anhydride was detected in the reaction mixture by GC analysis. The reaction mixture was cooled to 50° C. and the desired amount of solid Lithium Hydroxide was added. The reaction mixture was heated at 125-140° C. until the reaction mixture had cleared. Vacuum may be applied to remove excess water but is not necessary. The lubricants obtained had exemplary properties being clear and transparent and exhibited no oil bleed or undissolved saponified triglyceride.

TABLE 1

Properties of Maleated Triglyceride Oils/Lithium Hydroxide Neutralized

| Example | Percent Maleic Anhydride | Clarity | Oil Bleed | Viscosity (cP) |
|---|---|---|---|---|
| 1) Soybean Oil[a] | 7.5 | Transparent | None | 1200 |
| 2) Soybean Oil[a] | 10 | Transparent | None | 40000 |
| 3) Soybean Oil[a] | 12 | Transparent | None | Soft Gel (Tacky) |
| 4) Soybean Oil[b] | 14 | Transparent | None | Hard Gel (no Tack) |
| 5) Linseed Oil[a] | 10 | Transparent | None | 80000 |
| 6) Linseed Oil[a] | 12 | Transparent | None | Soft Gel (Tacky) |

TABLE 1-continued

| Properties of Maleated Triglyceride Oils/Lithium Hydroxide Neutralized | | | | |
|---|---|---|---|---|
| Example | Percent Maleic Anhydride | Clarity | Oil Bleed | Viscosity (cP) |
| 7) Linseed Oil[b] | 14 | Transparent | None | Hard Gel (no Tack) |
| 8) Safflower Oil[a] | 10 | Transparent | None | 70000 |
| 9) Safflower Oil[b] | 14 | Transparent | None | Hard Gel (no Tack) |
| 10) Avacodo Oil | 12 | Transparent | None | Soft Gel (Tacky) |
| 11) Sunflower Oil[b] | 14 | Transparent | None | Hard Gel (no Tack) |

[a](0.25 eq:1.0 eq. Maleic Anhydride)

[b](0.5 eq:1.0 eq. Maleic Anhydride)

All patents, patent applications and publications cited in this application including all cited references in those patents, applications and publications, are hereby incorporated by reference in their entirety for all purposes to the same extent as if each individual patent, patent application or publication were so individually denoted.

While the many embodiments of the invention have been disclosed above and include presently preferred embodiments, many other embodiments and variations are possible within the scope of the present disclosure and in the appended claims that follow. Accordingly, the details of the preferred embodiments and examples provided are not to be construed as limiting. It is to be understood that the terms used herein are merely descriptive rather than limiting and that various changes, numerous equivalents may be made without departing from the spirit or scope of the claimed invention.

What is claimed is:

1. Natural oil based lubricants of formulas (i) and (ii)

(i)

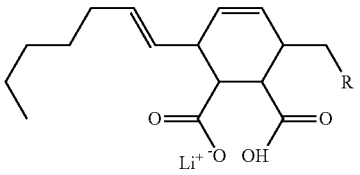

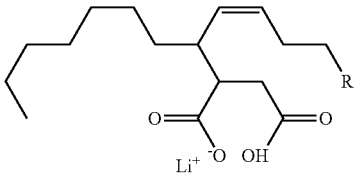

(ii)

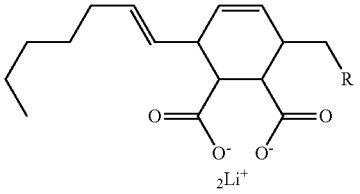

-continued

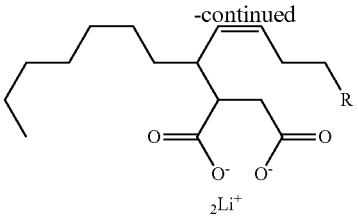

where R represents the additional carbon and functional moieties associated with a natural oil and where the natural oil or natural oil derivative contains greater than about 80 percent of unsaturated or conjugated unsaturated fatty acids and wherein said lubricant is the reaction product of said natural oil or natural oil derivative with a substrate capable of undergoing a Diels Alder reaction to form an adduct that is further reacted in a neutralization reaction with a lithium base to form an anhydrous gel.

2. The natural oil based lubricants of claim 1, wherein said natural oil is selected from the group consisting of soybean oil, linseed oil, safflower oil, sunflower oil, avocado oil, rapeseed oil, castor oil, tall oil, rosin oil and tung oil.

3. The natural oil based lubricant of claim 1, wherein said substrate is selected from the group consisting of maleic anhydride, itaconic acid, itaconic anhydride, acrylic and methacrylic acid, fumaric acid, aconitic acid, citraconic acid, maleimide and maleamic acid.

4. The natural oil based lubricants of claim 2, wherein said natural oil is soybean oil.

5. The natural oil based lubricants of claim 2, wherein said natural oil is linseed oil.

6. The natural oil based lubricants of claim 2, wherein said natural oil is safflower oil.

7. The natural oil based lubricants of claim 2, wherein said natural oil is avocado oil.

8. The natural oil based lubricants of claim 2, wherein said natural oil is sunflower oil.

9. The natural oil based lubricants of claim 3, wherein said substrate is maleic anhydride.

10. A method for making lubricants based on natural oils and derivatives thereof comprising:

(a) reacting the natural oil fatty acid or derivative a suitable substrate that is capable of undergoing a Diels Alder reaction with the natural oil to form an adduct; and (b) subjecting the product of step (a) to a controlled non-aqueous neutralization with a suitable inorganic base.

11. The method of claim 10, wherein said natural oil is selected from the group consisting of soybean oil, linseed oil, safflower oil, sunflower oil, avocado oil, rapeseed oil, castor oil, tall oil, rosin oil and tung oil.

12. The method of claim 11, wherein said natural oil is soybean oil.

13. The method of claim 11, wherein said natural oil is linseed oil.

14. The method of claim 11, wherein said natural oil is safflower oil.

15. The method of claim 11, wherein said natural oil is avocado oil.

16. The method of claim 11, wherein said natural oil is sunflower oil.

17. The method of claim 10 where the substrate is maleic anhydride.

18. The method of claim 10 where the base is lithium hydroxide or lithium carbonate.

19. A natural oil based lubricant obtained by the process of:

treating soy bean oil to a form conjugated soil bean oil comprising a conjugated diene;

reacting said conjugated diene with an α, β-ethylenically unsaturated dicarboxy compound in a Diels-Alder cycloaddition reaction to form an anhydride ring; and opening said anhydride ring to form a fully or partially neutralized acid salt.

20. A natural oil based lubricant obtained by the process of:

treating a natural oil to a form a conjugated natural oil comprising a conjugated diene;

reacting said conjugated diene with an α, β-ethylenically unsaturated dicarboxy compound in a Diels-Alder cycloaddition reaction to form an anhydride ring; and opening said anhydride ring to form a fully or partially neutralized acid salt.

21. The natural oil based lubricants of claim 20, wherein said natural oil is selected from the group consisting of soybean oil, linseed oil, safflower oil, sunflower oil, avocado oil, rapeseed oil, castor oil, tall oil, rosin oil, tung oil, linoleic acid, α-linolenic acid, arachidonic acid, icosapentaenoic acid and docosahexaenoic acid.

22. The natural oil based lubricant of claim 20, wherein said α, β-ethylenically unsaturated dicarboxy compound is selected from the group consisting of maleic anhydride, itaconic acid, itaconic anhydride, acrylic and methacrylic acid, fumaric acid, aconitic acid, citraconic acid, maleimide and maleamic acid.

23. The natural oil based lubricants of claim 20 further comprising the reaction product of a second α, β-ethylenically unsaturated dicarboxy compound in an ene reaction.

24. The natural oil based lubricant of claim 23 wherein said second α, β-ethylenically unsaturated dicarboxy compound is selected from the group consisting of maleic anhydride, itaconic acid, itaconic anhydride, acrylic and methacrylic acid, fumaric acid, aconitic acid, citraconic acid, maleimide and maleamic acid.

25. The natural oil based lubricants of claim 20 wherein said acid salt is at least partially neutralized with a salt selected from the group consisting of lithium hydroxide and lithium carbonate.

26. A method for making natural oil based lubricants comprising:

forming a conjugated natural oil from a natural oil wherein said conjugated natural oil comprises a conjugated diene having a structure $$R^1—CH=CH—CH=CH—R^2$$

wherein said $R^1$ and $R^2$ represent the additional moieties associated with said conjugated natural oil;

reacting said conjugated diene with an α, β-ethylenically unsaturated dicarboxy compound to form a maleated natural oil comprising an anhydride ring having a structure:

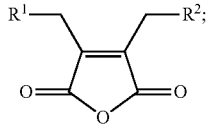

and opening said anhydride ring.

27. The method for making natural oil based lubricants of claim 26 wherein said opening of said anhydride ring comprises forming a full or partially neutralized acid salt.

28. The method for making natural oil based lubricants of claim 26 wherein said forming of said conjugated natural oil from said natural oil comprises reacting said natural oil with a double bond isomerization catalyst.

29. The method for making natural oil based lubricants of claim 28 wherein said double bond isomerization catalyst is iodine.

30. The method for making natural oil based lubricants of claim 26 wherein said forming of said conjugated natural oil from said natural oil comprises reaction of said natural oil with a second α, β-ethylenically unsaturated dicarboxy compound in an Alder-ene addition.

31. The method for making natural oil based lubricants of claim 30 wherein said second α, β-ethylenically unsaturated dicarboxy compound is selected from the group consisting of maleic anhydride, itaconic acid, itaconic anhydride, acrylic and methacrylic acid, fumaric acid, aconitic acid, citraconic acid, maleimide and maleamic acid.

32. The method for making natural oil based lubricants of claim 26 wherein said opened anhydride ring is at least partially neutralized with a salt selected from the group consisting of lithium hydroxide and lithium carbonate.

33. The method for making natural oil based lubricants of claim 26 wherein said maleated natural oil comprising an anhydride ring has a structure:

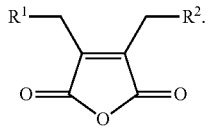

34. The method for making natural oil based lubricants of claim 33 wherein said maleated natural oil comprising an anhydride ring has a structure:

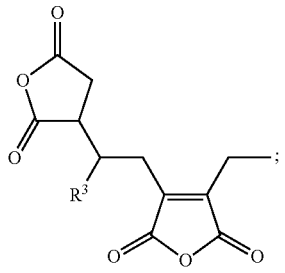

wherein $R^3$ is $R^1$ less an alkene.

* * * * *